US008025357B2

(12) United States Patent
Fukasawa et al.

(10) Patent No.: US 8,025,357 B2
(45) Date of Patent: Sep. 27, 2011

(54) FLUID EJECTING APPARATUS AND EJECTING HEAD MAINTENANCE METHOD

(75) Inventors: Shigenori Fukasawa, Shiojiri (JP); Satoru Hosono, Azumino (JP); Hideki Okumura, Shiojiri (JP); Seiji Tojo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 469 days.

(21) Appl. No.: 12/234,013

(22) Filed: Sep. 19, 2008

(65) Prior Publication Data

US 2009/0079785 A1 Mar. 26, 2009

(30) Foreign Application Priority Data

Sep. 20, 2007 (JP) ..... 2007-243838

(51) Int. Cl.
*B41J 2/165* (2006.01)

(52) U.S. Cl. ..... 347/23

(58) Field of Classification Search ..... 347/9, 22, 347/23, 30

See application file for complete search history.

(56) References Cited

U.S. PATENT DOCUMENTS 5,543,826 A * 8/1996 Kuronuma et al. ..... 347/23

FOREIGN PATENT DOCUMENTS

JP 59-131464 7/1984
JP 05-338189 12/1993

* cited by examiner

*Primary Examiner* — An Do
(74) *Attorney, Agent, or Firm* — Workman Nydegger

(57) ABSTRACT

A method for maintaining a fluid ejecting apparatus including an ejecting head that has an ejecting surface in which a plurality of ejecting ports that eject fluid are formed, and a maintenance portion that performs maintenance processing to recover the ejection of fluid from the ejecting ports and that has a cap member and a wiping member. The method includes performing capping processing to put the cap member on the ejecting surface and to suck, and then wiping processing to wipe the ejecting surface with the wiping member, and performing the capping processing again and then waiting a predetermined time without performing the wiping processing.

7 Claims, 12 Drawing Sheets

FIG. 12

| TYPE | KIND OF CLEANING |
|---|---|
| A | TIMER CLEANING<br>INK CARTRIDGE REPLACEMENT CLEANING<br>(MANUAL CLEANING) |
| B | INITIAL FILLING CLEANING<br>MANUAL CLEANING<br>(INK CARTRIDGE REPLACEMENT CLEANING) |

FLUID EJECTING APPARATUS AND EJECTING HEAD MAINTENANCE METHOD

CROSS-REFERENCE TO RELATED APPLICATIONS

This application is based upon and claims the benefit of priority from prior Japanese Patent Applications No. 2007-243838, filed on Sep. 20, 2007, the entire contents of which are incorporated herein by reference.

BACKGROUND

1. Technical Field

The present invention relates to a fluid ejecting apparatus and an ejecting head maintenance method.

2. Related Art

There is known a fluid ejecting apparatus in which a cleaner such as a wiper is provided on a discharge-port forming surface of an ejecting head that ejects fluid. In addition, there is known an ejecting head maintenance method including wiping the discharge-port forming surface with a wiper, for example. As a technology for such apparatus and method, there is disclosed a technology to put a lid on nozzles with a small amount of ink flowing out thereof, to thereby eliminate concave meniscuses, to uniformly wet the lid, and to prevent air bubbles from entering the nozzles (see, for example, JP-A-59-131464).

In addition, there is disclosed a technology to minimize the negative effect of defective discharge caused by blade debris or thickened ink attached to the edges of the discharge ports after the discharge-port forming surface is wiped many times, and to maintain the wiping effect, that is, to constantly keep the edges of the discharge ports clean by wiping (see, for example, JP-A-5-338189).

However, when a high-viscosity ink having a viscosity higher than that of known inks is used in the above known fluid ejecting apparatuses and ejecting head maintenance methods, at the time of cleaning, thickened ink is rubbed against the nozzles, thereby damaging the discharge-port forming surface. When discharge ports having a diameter larger than that of known discharge ports are used, the force sucking ink from the discharge ports is increased, and ink remaining on the discharge-port forming surface is sucked into the ejecting head. This results in the absence of ink on the discharge-port forming surface at the time of cleaning, and the discharge-port forming surface is damaged by wiping.

SUMMARY

An advantage of some aspects of the invention is to provide a fluid ejecting apparatus in which a head can be prevented from being damaged by cleaning, and a head maintenance method by which a head can be prevented from being damaged by cleaning.

According to an aspect of the invention, a method for maintaining a fluid ejecting apparatus is provided. The fluid ejecting apparatus includes an ejecting head that has an ejecting surface in which a plurality of ejecting ports that eject fluid are formed, and a maintenance portion that performs maintenance processing to recover the ejection of fluid from the ejecting ports and that has a cap member and a wiping member. The method includes performing capping processing to put the cap member on the ejecting surface and to suck, and then wiping processing to wipe the ejecting surface with the wiping member, and performing the capping processing again and then waiting a predetermined time without performing the wiping processing.

By maintaining as above, the wiping processing, which is performed after every capping processing in known maintenance methods, is not performed after the capping processing is performed again. Therefore, thickened fluid can be prevented from being rubbed against the ejecting surface by wiping. In addition, the ejecting surface is prevented from being wiped without sufficient fluid thereon. Therefore, the ejecting surface can be prevented from being damaged by wiping. By waiting a predetermined time after the capping processing is performed again, fluid attached to the vicinities of the ejecting ports in the ejecting surface can be sucked into the ejecting head through the ejecting ports due to the difference in pressure between inside and outside the ejecting head. Therefore, fluid on the ejecting surface can be removed without performing wiping processing. Consequently, fluid can be prevented from remaining on the ejecting surface and thickening.

It is preferable that after the capping processing is performed again, the temperature of the ejecting head be measured, the measured temperature be compared to a preset set temperature, and if the temperature of the ejecting head is higher than or equal to the set temperature, waiting be performed for a predetermined time without performing the wiping processing.

By maintaining as above, if the temperature of the ejecting head becomes higher than or equal to the set temperature and thereby fluid remaining on the ejecting surface is thickened, the thickened fluid can be prevented from being rubbed against the ejecting surface by wiping processing and therefore the ejecting surface can be prevented from being damaged.

It is preferable that after the capping processing is performed again, the elapsed time since the last maintenance processing be measured, the measured time be compared to a preset set time, and if the measured time exceeds the set time, waiting be performed for a predetermined time without performing the wiping processing.

By maintaining as above, if the predetermined time has elapsed since the last maintenance processing and thereby fluid remaining on the ejecting surface is thickened, the thickened fluid can be prevented from being rubbed against the ejecting surface by wiping processing and therefore the ejecting surface can be prevented from being damaged.

It is preferable that after the capping processing is performed again, the kind of performed cleaning be determined, and if the kind of cleaning is a timer cleaning after an elapse of a set time, waiting be performed for a predetermined time without performing the wiping processing.

By maintaining as above, if fluid remaining on the ejecting surface is thickened at the time of timer cleaning, the thickened fluid can be prevented from being rubbed against the ejecting surface by wiping processing and therefore the ejecting surface can be prevented from being damaged.

It is preferable that a method according to an aspect of the invention further include performing flushing processing to put the cap member on the ejecting surface and to eject liquid from the ejecting ports.

By maintaining as above, if liquid remaining in the ejecting ports is thickened, the thickened liquid is discharged by flushing processing and therefore the ejection of fluid from the ejecting ports can be recovered. In addition, the meniscuses of fluid in the ejecting ports can be smoothed by flushing.

It is preferable that a method according to an aspect of the invention further include keeping the cap member put on the ejecting surface.

By maintaining as above, fluid remaining in the ejecting ports and on the ejecting surface can be prevented from evaporating and therefore can be prevented from thickening.

According to another aspect of the invention, a fluid ejecting apparatus includes an ejecting head that has an ejecting surface in which a plurality of ejecting ports that eject fluid are formed, a maintenance portion that performs maintenance processing to recover the ejection of fluid from the ejecting ports and that has a cap member and a wiping member, and a control portion that controls the maintenance portion. The control portion performs capping processing to put the cap member on the ejecting surface and to suck, and then wiping processing to wipe the ejecting surface with the wiping member, and thereafter performs the capping processing again and then waits a predetermined time without performing the wiping processing.

By configuring as above, the cap member and the wiping member are controlled by the control portion, and the wiping processing, which is performed after every capping processing in known fluid ejecting apparatuses, is not performed after the capping processing is performed again. Therefore, thickened fluid can be prevented from being rubbed against the ejecting surface by the wiping member. In addition, the ejecting surface is prevented from being wiped without sufficient fluid thereon. Therefore, the ejecting surface can be prevented from being damaged by the wiping member. By controlling the cap member with the control portion and waiting a predetermined time after the capping processing is performed again, fluid attached to the vicinities of the ejecting ports in the ejecting surface can be sucked into the ejecting head through the ejecting ports due to the difference in pressure between inside and outside the ejecting head. Therefore, fluid on the ejecting surface can be removed without performing wiping processing. Consequently, fluid can be prevented from remaining on the ejecting surface and thickening.

BRIEF DESCRIPTION OF THE DRAWINGS

The invention will be described with reference to the accompanying drawings, wherein like numbers reference like elements.

FIG. 12 is a table showing the kinds of cleaning of an ink jet printer according to a fourth embodiment of the invention.

DESCRIPTION OF EXEMPLARY EMBODIMENTS

An embodiment of a fluid ejecting apparatus and an ejecting head maintenance method according to the invention will now be described with reference to the drawings. In the following drawings, the scale of each member is appropriately changed so that each member has a viewable size.

Figure 1:
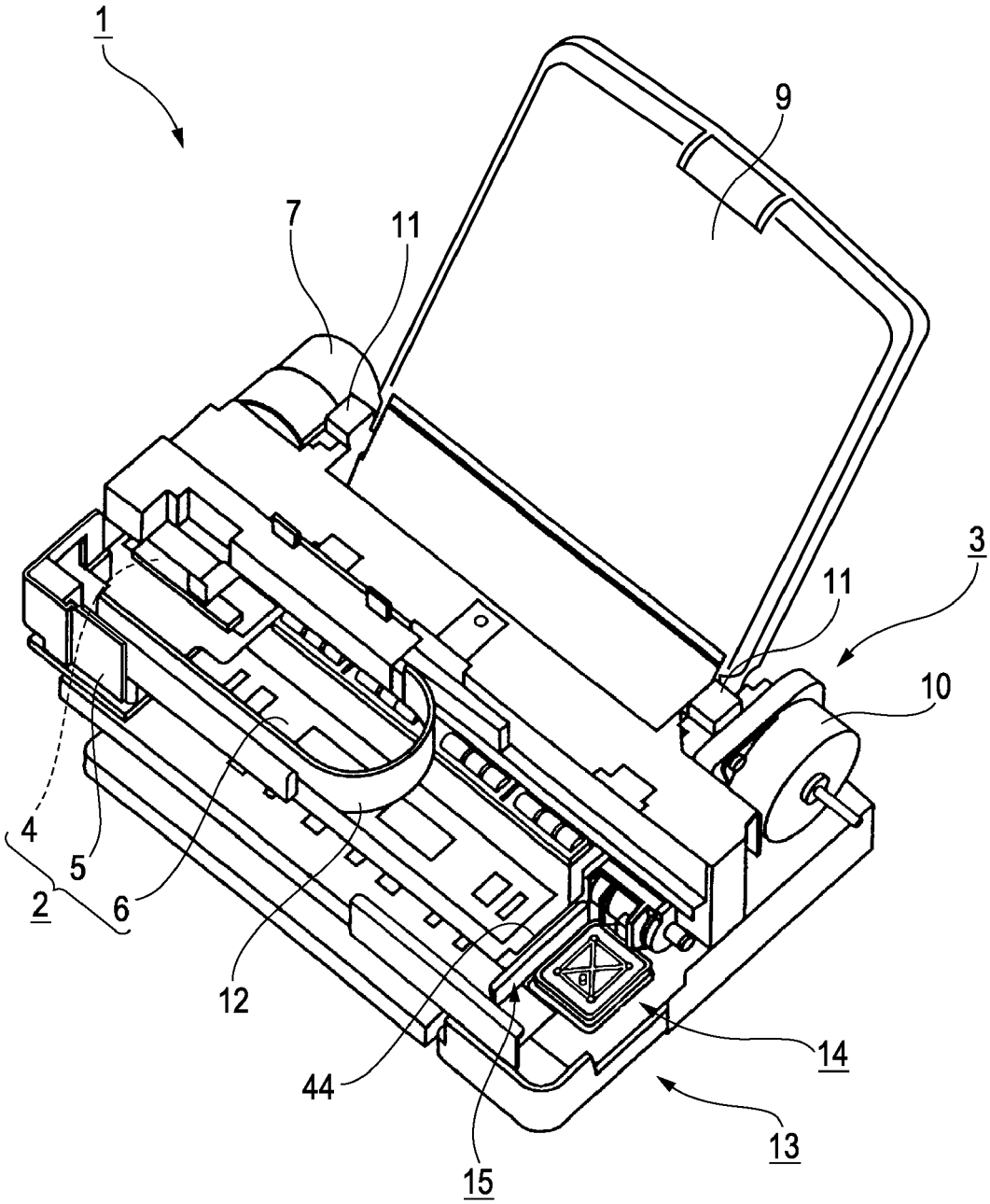
FIG. 1 is a perspective view showing an ink jet printer according to an embodiment of the invention.
Figure 2:
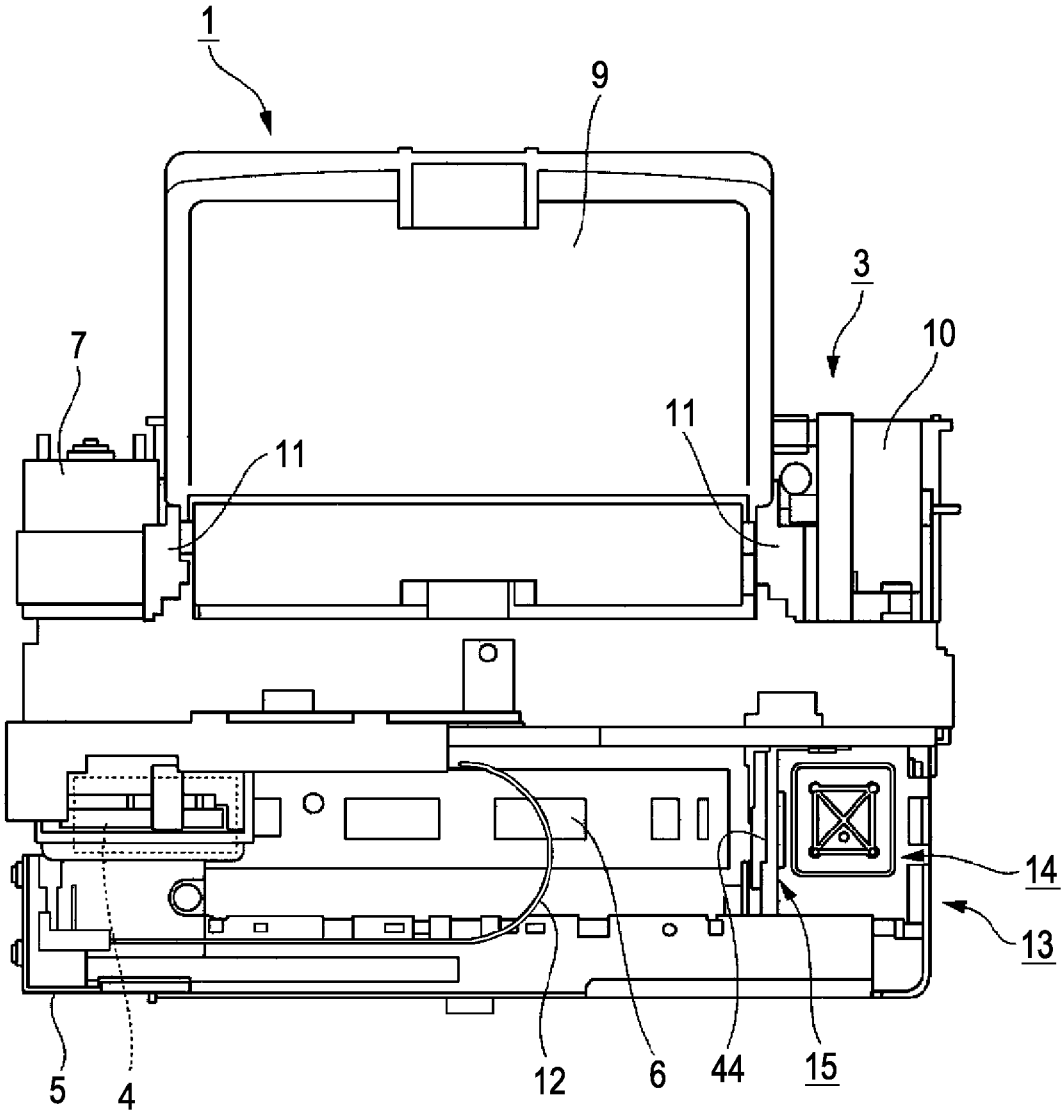
FIG. 2 is a plan view showing an ink jet printer according to an embodiment of the invention.

FIG. 1 is a perspective view showing an example of a fluid ejecting apparatus according to this embodiment, and FIG. 2 is a plan view showing the same. The fluid ejecting apparatus according to this embodiment is a fluid ejecting apparatus that ejects a fluid such as ink. A description will be given using an ink jet recording apparatus that ejects ink from ejecting ports of a recording head onto a recording medium, thereby performing recording on the recording medium, as an example of a fluid ejecting apparatus. In the following description, an ink jet printer that discharges (ejects) ink droplets onto recording paper serving as a recording medium, thereby performing recording on the recording paper will be described as an example of the ink jet recording apparatus.

As shown in FIGS. 1 and 2, an ink jet printer 1 has a recording unit 2 that performs recording on recording paper with ink and a recording paper transport mechanism 3 that transports recording paper. The recording unit 2 includes a recording head 4 (ejecting head) that ejects ink, a carriage 5 that can move, supporting the recording head 4, and a platen 6 that is disposed opposite the recording head 4 and the carriage 5 and supports recording paper onto which ink is ejected.

The ink jet printer 1 has a carriage drive mechanism 7 that includes a motor for moving the carriage 5, and a carriage guide member that guides the movement of the carriage 5. The carriage 5, being guided by the carriage guide member, is moved by the carriage drive mechanism 7 in the main scanning direction. Recording paper is moved by the recording paper transport mechanism 3 relative to the recording unit 2 in the subscanning direction perpendicular to the main scanning direction.

In addition, the ink jet printer 1 has a paper cassette 9 that contains recording paper. The paper cassette 9 is detachably provided on the back of the main body of the ink jet printer 1. The paper cassette 9 can contain a stack of recording paper.

The recording paper transport mechanism 3 has a paper feeding roller for carrying the recording paper out of the paper cassette 9, a paper feeding roller drive unit 10 that includes a motor for driving the paper feeding roller, a recording paper guide member 11 that guides the movement of recording paper, a transport roller that is disposed downstream of the paper feeding roller in the transport direction, a transport roller drive unit that drives the transport roller, and a discharge roller that is disposed downstream of the recording unit 2 in the transport direction.

The paper feeding roller is configured to be able to pick up the uppermost one of the sheets of recording paper stacked in the paper cassette 9 and carry it out of the paper cassette 9. The recording paper in the paper cassette 9, being guided by the recording paper guide member 11, is carried to the transport roller by the paper feeding roller driven by the paper feeding roller drive unit 10. The recording paper carried to the transport roller is transported by the transport roller driven by the transport roller drive unit to the recording unit 2 disposed downstream in the transport direction.

The platen 6 of the recording unit 2 is disposed opposite the recording head 4 and the carriage 5 and supports the undersurface of the recording paper. The recording head 4 and the carriage 5 are disposed above the platen 6. The recording paper transport mechanism 3 transports the recording paper in the subscanning direction in conjunction with the recording operation by the recording unit 2. After recording by the recording unit 2, the recording paper is discharged from the front of the ink jet printer 1 by the recording paper transport mechanism 3 including the discharge roller.

The ink jet printer 1 has an ink supply tube 12 that supplies ink in an ink cartridge to the recording head 4 of the carriage 5. Ink in the ink cartridge is supplied through an ink supply needle to an ink supply channel, and is then supplied from the ink supply channel through the ink supply tube 12 to the recording head 4 of the carriage 5. The ink jet printer 1 has a maintenance unit 13 that can maintain the recording head 4.

The maintenance unit 13 (maintenance portion) includes a capping unit 14 and a wiping unit 15. The wiping unit 15 has a wiping member 44 that can face the recording head 4. The wiping unit 15 can wipe off foreign substances attached to an ejecting surface 17 (described below) of the recording head 4, such as residual ink, using the wiping member 44. The maintenance unit 13 is disposed at a home position of the carriage 5 and the recording head 4. The home position is set in an end region within a moving region where the carriage 5 moves but outside a recording region where the recording unit 2 performs the recording operation. When the power is cut off or the recording operation is not performed for a long time, the carriage 5 and the recording head 4 are disposed at the home position. A thermometer is connected to the recording head 4 so that the temperature of the recording head 4 can be measured.

Figure 3:
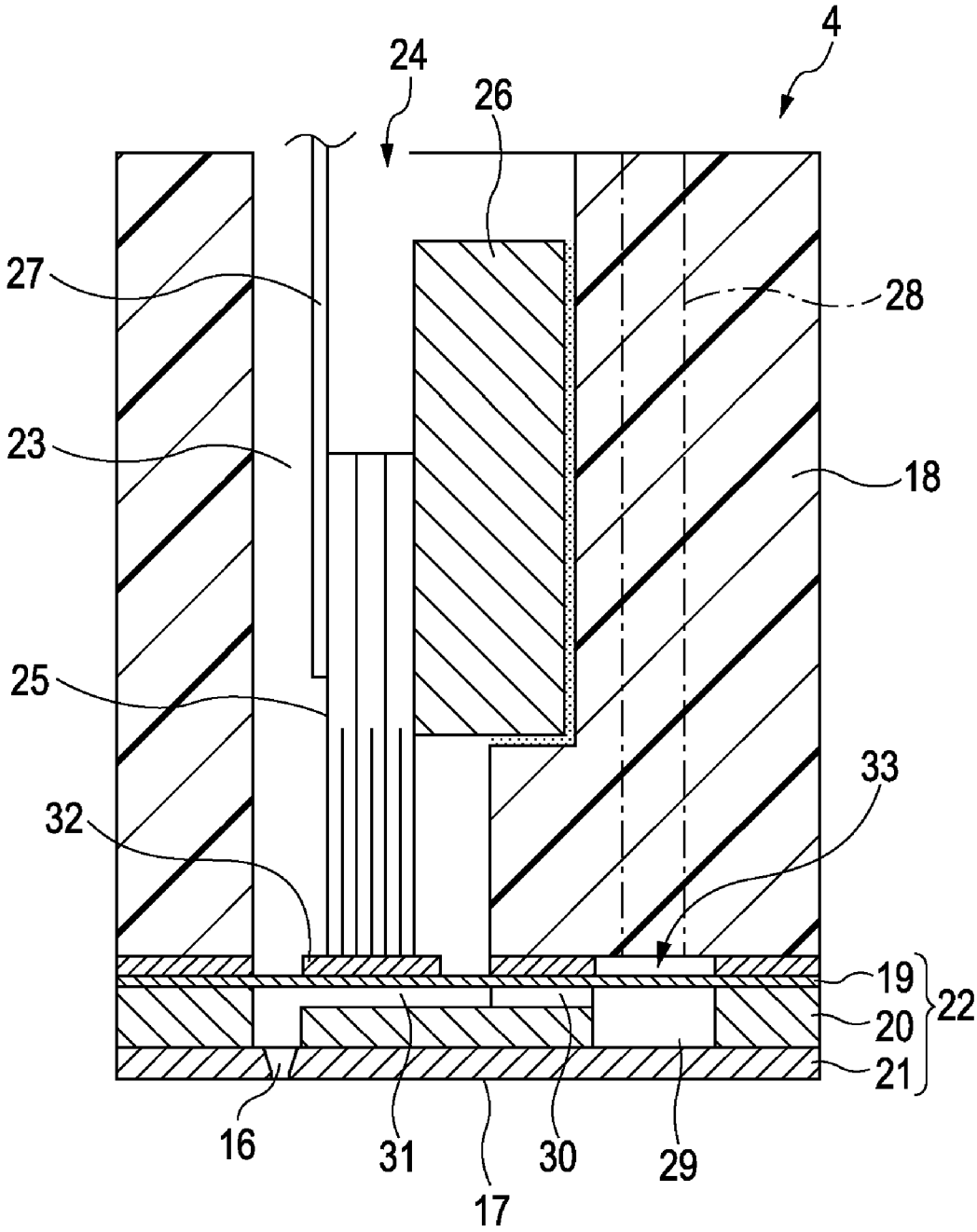
FIG. 3 is a sectional view showing a recording head that an ink jet printer according to an embodiment of the invention has.

FIG. 3 is a sectional view of the recording head 4. As shown in FIG. 3, the recording head 4 has a head main body 18 and a channel forming unit 22 including a vibrating plate 19, a channel substrate 20, and a nozzle substrate 21. The ejecting surface 17 is formed by the undersurface of the nozzle substrate 21. Ejecting ports 16 are formed in the nozzle substrate 21. The diameter of the ejecting ports 16 is, for example, about 15% larger than usual in accordance with the ink used. The channel forming unit 22 is formed by stacking and bonding the vibrating plate 19, the channel substrate 20, and the nozzle substrate 21.

The recording head 4 has a space 23 formed inside the head main body 18, and a drive unit 24 disposed in the space 23. The drive unit 24 has a plurality of piezoelectric elements 25, a fixing member 26 that supports the upper ends of the piezoelectric elements 25, and a flexible cable 27 that supplies drive signals to the piezoelectric elements 25. The piezoelectric elements 25 are provided so as to correspond one-to-one to the plurality of ejecting ports 16.

The recording head 4 has an inner channel 28, a common ink chamber 29, ink supply ports 30, and pressure chambers 31. The inner channel 28 is formed inside the head main body 18. Ink supplied from the ink cartridge through the ink supply tube 12 flows the inner channel 28. The common ink chamber 29 is formed by the channel forming unit 22 including the vibrating plate 19, the channel substrate 20, and the nozzle substrate 21, and is connected with the inner channel 28. The ink supply ports 30 are formed by the channel forming unit 22, and are connected with the common ink chamber 29. The pressure chambers 31 are formed by the channel forming unit 22, and are connected with the ink supply ports 30. The plurality of pressure chambers 31 are provided so as to correspond to the plurality of ejecting ports 16. The plurality of ejecting ports are connected one-to-one to the plurality of pressure chambers 31.

The head main body 18 is formed of synthetic resin. The vibrating plate 19 is formed by laminating an elastic film on a support plate formed of metal, for example, stainless steel. In the parts of the vibrating plate 19 corresponding to the pressure chambers 31 are formed islands 32 connected to the lower ends of the piezoelectric elements 25. At least part of the vibrating plate 19 is elastically deformed depending on the drive of the piezoelectric elements 25. A compliance portion 33 is formed between the vibrating plate 19 and the vicinity of the lower end of the inner channel 28. The channel substrate 20 has a depression for forming the common ink chamber 29, the ink supply ports 30, and the pressure chambers 31 that connect the lower end of the inner channel 28 and the ejecting ports 16. In this embodiment, the channel substrate 20 is formed by anisotropic etching of silicon.

The nozzle substrate 21 has the plurality of ejecting ports 16 formed at predetermined intervals (pitch) in a predetermined direction. The nozzle substrate 21 of this embodiment is a plate-like member formed of metal, for example, stainless steel. As described above, the ejecting surface 17 is formed by the undersurface of the nozzle substrate 21.

In the ink jet printer 1 having such a structure, as shown in FIGS. 1 and 2, ink supplied from the ink cartridge through the ink supply tube 12 flows into the upper end of the inner channel 28 shown in FIG. 3. The lower end of the inner channel 28 is connected to the common ink chamber 29. Flowing from the ink cartridge through the ink supply tube 12 into the upper end of the inner channel 28, ink flows through the inner channel 28 and is then supplied to the common ink chamber 29. The Ink supplied to the common ink chamber 29 is distributed through the ink supply ports 30 to the plurality of pressure chambers 31.

The input of drive signals into the piezoelectric elements 25 via the cable 27 causes the piezoelectric elements 25 to expand and contract. The vibrating plate 19 is thereby deformed (moved) toward and away from the pressure chambers 31. This changes the volumes of the pressure chambers 31 and therefore the pressures in the pressure chambers 31 containing ink. This change in pressure ejects (discharge) ink from the ejecting ports 16. As described above, the piezoelectric elements 25 of this embodiment change the pressures in the pressure chambers 31 connected to the ejecting ports 16, on the basis of the input drive signals, in order to eject ink from the ejecting ports 16.

Figure 4:
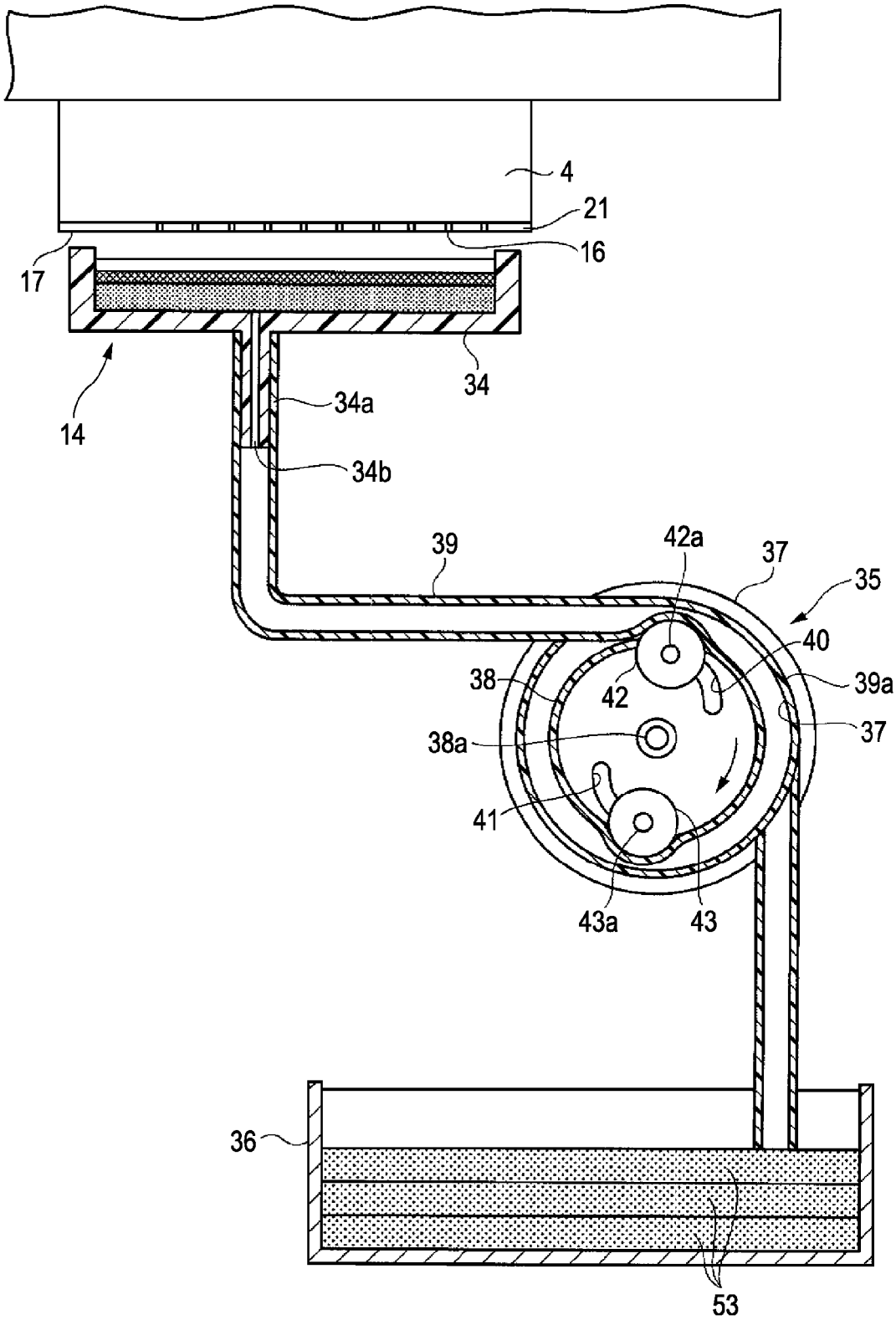
FIG. 4 is a view showing the structure of a suction unit connected to a cap member according to an embodiment of the invention.

FIG. 4 is a view showing the structure of a suction unit 35 connected to the capping unit 14. A discharge portion 34*a* for discharging ink in the cap member 34 protrudes downward from the bottom of the cap member 34. A discharge channel 34*b* is formed inside the discharge portion 34*a*. To the discharge portion 34*a* is connected one end of a discharge tube 39 formed of a flexible material. The other end of the discharge tube 39 is located in a waste ink tank 36. The waste ink tank 36 contains waste ink absorbers 53 formed of a porous material so that the waste ink absorbers 53 absorb recovered ink. This waste ink tank 36 is disposed under the platen 6.

A tube-pump suction unit 35 is disposed between the cap member 34 and the waste ink tank 36. The suction unit 35 has a cylindrical case 37, in which a pump wheel 38 is contained rotatably around a wheel shaft 38*a* provided in the center of the case 37. In this case 37, a middle portion 39*a* of the discharge tube 39 is contained, curving along the inner curved wall 37*a* of the case 37.

The pump wheel 38 has a pair of roller guide grooves 40 and 41 formed therein. The roller guide grooves 40 and 41 are arc-shaped and convex outward, and face each other with the wheel shaft 38*a* therebetween. A first end of each of the roller guide grooves 40 and 41 is located near the circumference of the pump wheel 38, and a second end thereof is located near the center of the pump wheel 38. That is, each of the roller guide grooves 40 and 41 extends gradually away from the circumference of the pump wheel 38 as it extends from the first end thereof to the second end thereof. A pair of rollers 42 and 43 serving as pressing units are supported by rotating shafts 42*a* and 43*a*, respectively, disposed in the roller guide grooves 40 and 41, respectively. The rotating shafts 42*a* and 43*a* can slide in the roller guide grooves 40 and 41, respectively.

Rotating the pump wheel 38 in a forward direction (direction of arrow) causes the rollers 42 and 43 to move toward the first ends (near the circumference of the pump wheel 38) of the roller guide grooves 40 and 41, respectively, and to rotate while pressing parts of the middle portion 39*a* of the discharge tube 39 sequentially from the upstream side to the downstream side. This rotation depressurizes the inside of the discharge tube 39 on the upstream side of the suction unit 35. Therefore, the ink in the cap member 34 is discharged gradually toward the waste ink tank 36 by the rotational operation of the pump wheel 38 in the forward direction. By generating negative pressure in the space formed between the ejecting surface 17 and the cap member 34, ink can be sucked from the ejecting ports 16 in the ejecting surface 17.

Rotating the pump wheel 38 in the reverse direction (opposite direction from arrow) causes the rollers 42 and 43 to move toward the second ends (near the center of the pump wheel 38) of the roller guide grooves 40 and 41, respectively. Due to this movement, the rollers 42 and 43 stop pressing the middle portion 39*a* of the discharge tube 39, and the pressure inside the discharge tube 39 is restored. The pump wheel 38 is rotary-driven by the paper feeding roller drive mechanism 10. The cap member 34, being driven by a drive unit (not shown), can bring its upper end face into contact with the ejecting surface 17 of the recording head 4 so as to form a closed space, and take its upper end face out of contact with the ejecting surface 17 of the recording head 4.

The ink jet printer 1 can perform maintenance processing for the recording head 4 using the maintenance unit 13. The maintenance unit 13 performs maintenance processing including an operation to discharge ink from the ejecting ports 16, in cooperation with the recording head 4, in order to maintain the ejection properties of the recording head 4.

The maintenance processing includes at least one of a flushing operation to eject ink onto the cap member 34 from the ejecting ports 16, a wiping operation using the wiping member 44 of the wiping unit 15, and a suction operation using the cap member 34 of the capping unit 14 and the suction unit 35. The flushing operation includes an operation to preliminarily eject (discharge) ink onto the cap member 34 from the ejecting ports 16 at the home position before ink is ejected onto the recording paper from the ejecting ports 16 in the recording region. By this operation, thickened ink near the ejecting ports 16 is discharged, and the ejection properties of the ejecting ports 16 are maintained or recovered.

The suction operation includes an operation to make the ejecting surface 17 and the cap member 34 face each other at the home position, to generate negative pressure in the space formed between the ejecting surface 17 and the cap member 34 using the suction unit 35, and to thereby suck ink from the ejecting ports 16 of the ejecting surface 17. By this operation, thickened ink, dust in the ejecting ports 16, air bubbles in the recording head 4, and so forth that cannot be completely discharged by the flushing operation are discharged together with ink from the ejecting ports 16, and the ejection properties of the ejecting ports 16 are maintained or recovered.

Figure 5:
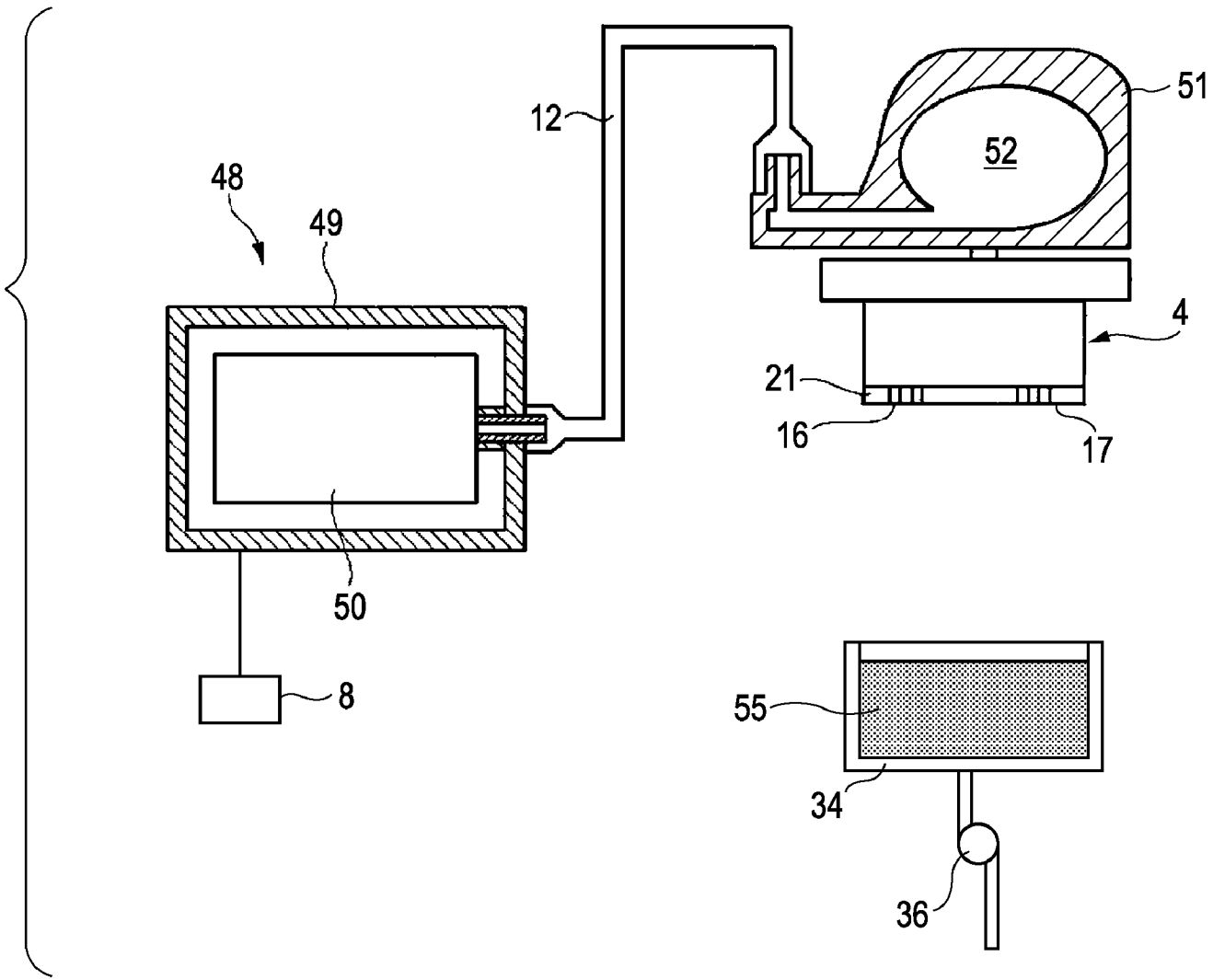
FIG. 5 is a view for illustrating a supply route of ink of an ink jet printer according to an embodiment of the invention.

FIG. 5 is a schematic view for illustrating a supply route of ink. As shown in FIG. 5, the ink supply tube 12 connects an ink cartridge 48 and a subtank 51 connected to the recording head 4. Ink supplied from the ink cartridge 48 to the ink supply tube 12 is supplied to the subtank 51. The ink cartridge 48 is disposed at a position slightly lower than the ejecting surface 17 of the recording head 4 in view of the water head value. In this embodiment, the ink cartridge 48 includes a case member 49 and an ink container 50 housed in the case member 49 and formed of a plastic material. The subtank 51 has an ink chamber 52. Ink supplied to the ink chamber 52 is supplied to the recording head 4. A detection unit 8 is connected to the case member 49 so that the replacement of the ink cartridge 48 can be detected.

Figure 6:
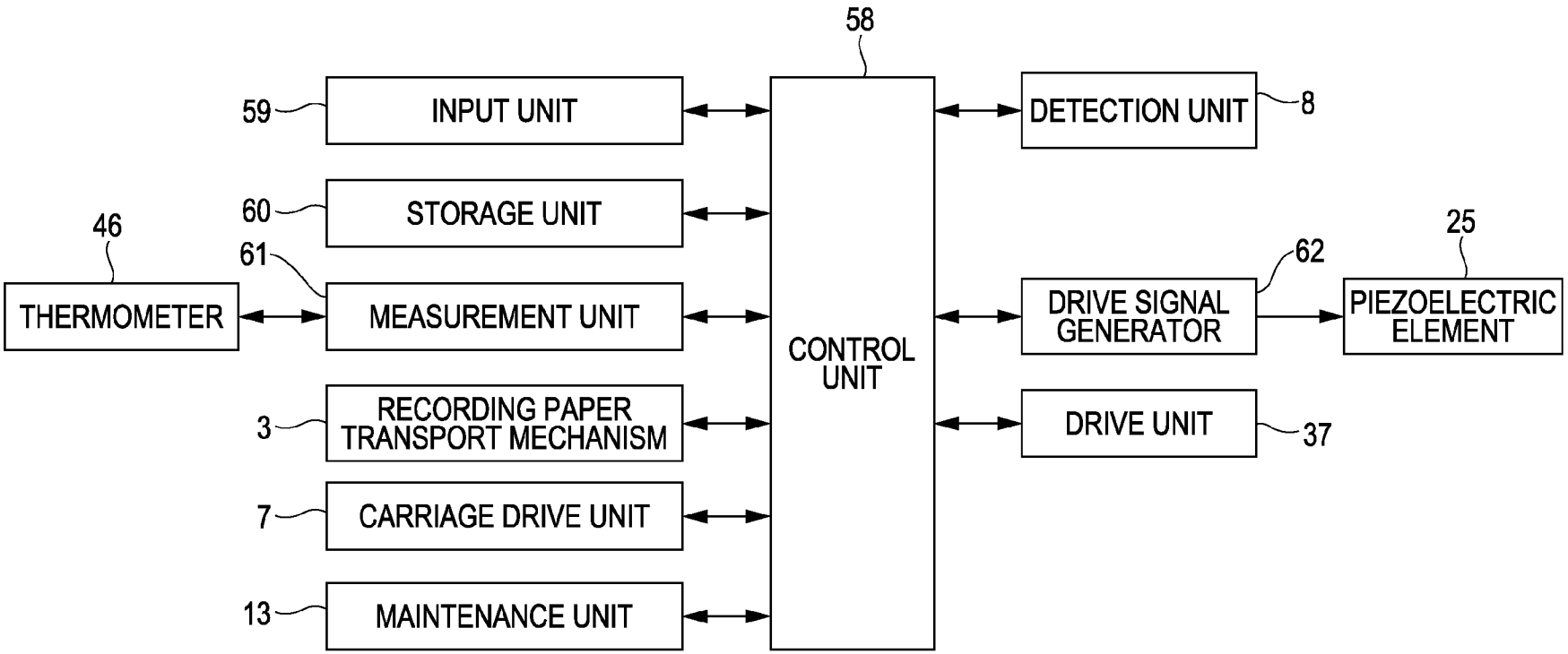
FIG. 6 is a block diagram showing the electrical configuration of an ink jet printer according to an embodiment of the invention.

FIG. 6 is a block diagram showing the electrical configuration of the ink jet printer 1. The ink jet printer 1 in this embodiment has a control unit 58 that controls the operation of the whole ink jet printer 1. To the control unit 58 (control portion) are connected an input unit 59, a storage unit 60, and a measurement unit 61. Various types of information on the operation of the ink jet printer 1 are input through the input unit 59. The storage unit 60 stores various types of information on the operation of the ink jet printer 1. The measurement unit 61 can time even when the power is cut. The measurement unit 61 is connected to a thermometer 46 capable of detecting the temperature of the recording head 4 so that the temperature of the recording head 4 can be measured.

To the control unit 58 are connected the drive unit 37, the recording paper transport mechanism 3, the carriage drive unit 7, the maintenance unit 13 including the capping unit 14 and the wiping unit 15, and the detection unit 8. The ink jet printer 1 has a drive signal generator 62 that generates a drive signal to input into the drive unit 24 including the piezoelectric elements 25. The drive signal generator 62 is connected to the control unit 58. Into the drive signal generator 62 are input data showing the amount of change in voltage value of a discharge pulse to input into one of the piezoelectric elements 25 of the recording head 4, and a timing signal that defines the timing of changing the voltage of the discharge pulse. The drive signal generator 62 generates a drive signal such as a discharge pulse on the basis of the input data and timing signal.

Input of a discharge pulse into one of the piezoelectric elements 25 from the drive signal generator 62 causes an ink droplet to be discharged from the corresponding ejecting port 16. More specifically, input of a discharge pulse into one of the piezoelectric elements 25 causes the piezoelectric element 25 to contract, thereby expanding the corresponding pressure chamber 31. After the expanded state of the pressure chamber 31 is maintained for a short time, the piezoelectric element 25 extends rapidly. Accordingly, the volume of the pressure chamber 31 is reduced to a reference volume or smaller, and the meniscus exposed in the corresponding ejecting port 16 is rapidly pressed outward. Consequently, a predetermined amount of ink is discharged in the form of a droplet from the ejecting port 16. Thereafter, the volume of the pressure chamber 31 returns to the reference volume so as to converge the vibration of the meniscus due to the discharge of an ink droplet in a short time.

Figure 7:
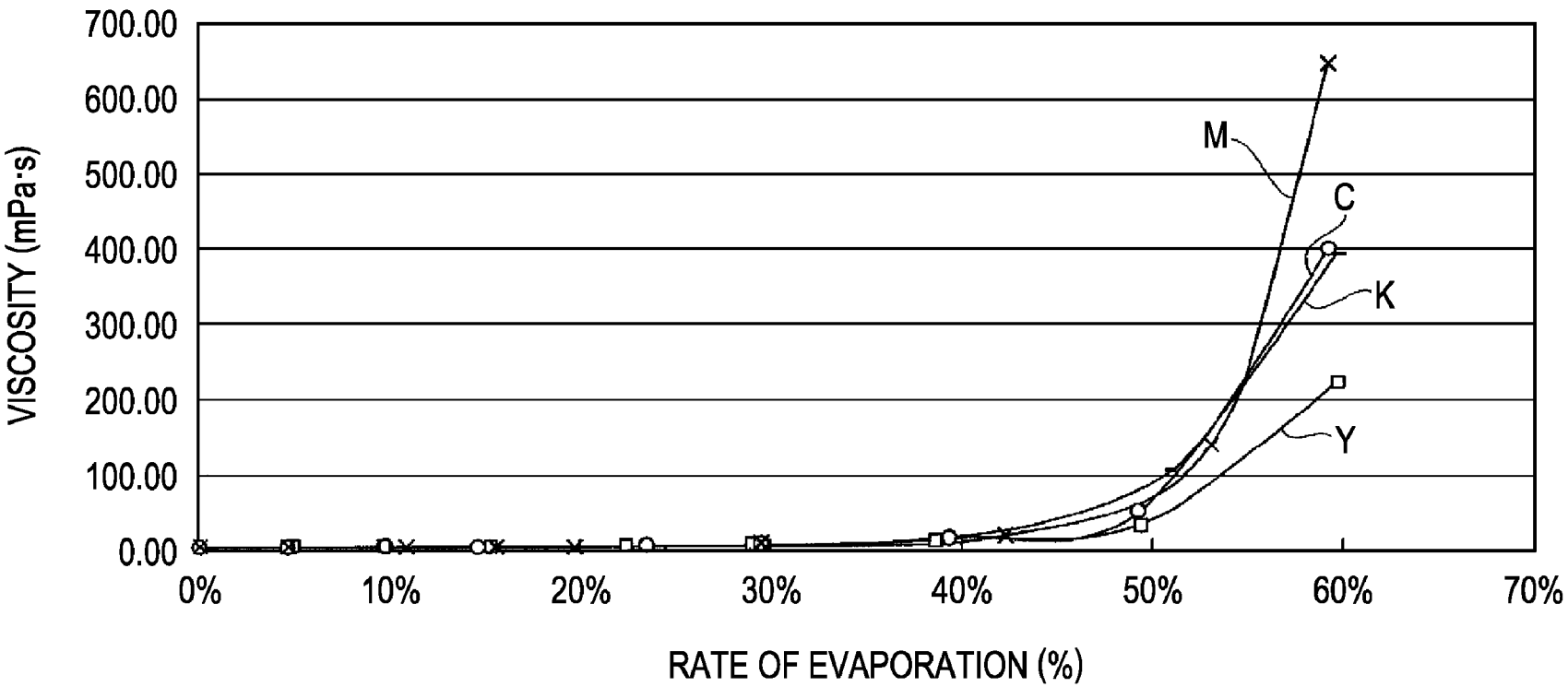
FIG. 7 is a graph showing the relationship between the viscosity and the rate of evaporation of ink according to an embodiment of the invention.

FIG. 7 is a graph showing the relationship between the viscosity and the rate of evaporation of the ink used in this embodiment. As shown in FIG. 7, when the rate of evaporation of the ink is 40% or less, the viscosity of the ink increases very little, and there is little difference in viscosity depending on the color Y, M, C, or K of the ink. However, when the rate of evaporation of the ink exceeds 40%, the viscosity of the ink increases with the rate of evaporation. When the rate of evaporation exceeds 50%, the viscosity increases sharply. In addition, there are significant differences in viscosity depending on the color Y, M, C, or K of the ink. In this embodiment, the M ink has the greatest tendency to thicken, and the Y ink has the lowest tendency to thicken.

Next, a first embodiment of a cleaning operation (maintenance method) of the ink jet printer 1 having the above-described structure will be described, focusing on the operation of the control unit 58, with reference to the flowchart of FIG. 8.

When cleaning is started (step S1), the control unit 58 activates the drive unit 37 to bring the upper end face of the cap member 34 into contact with the ejecting surface 17 (step S2). Next, the control unit 58 activates the maintenance unit 13, and suctions the fluid in the space formed between the cap member 34 and the ejecting surface 17 with the suction unit 35 (step S3). In this way, thickened ink in the ejecting ports 16 is discharged.

Next, the control unit 58 activates the drive unit 37, and takes the upper end face of the cap member 34 out of contact with the ejecting surface 17. Next, the control unit 58 activates the carriage drive unit 7 with the wiping member 44 set at a predetermined position, and wipes the ejecting surface 17 of the ejecting head 4 with the wiping member 44 of the wiping unit 15. In this way, foreign substances attached to the ejecting surface 17, such as residual ink, can be wiped off using the wiping member 44.

Next, as in the above-described steps S2 to S4, the control unit 58 brings the upper end face of the cap member 34 into contact with the ejecting surface 17 (step S6) sucks the fluid in the space formed between the cap member 34 and the ejecting surface 17 (step S7), and takes the upper end face of the cap member 34 out of contact with the ejecting surface 17 (step S8).

Next, the control unit 58 waits a predetermined time without performing wiping (step S9). The waiting time is appropriately adjusted to the viscosity of ink and the diameter of the ejecting ports 16. In this embodiment, the waiting time is, for example, 20 seconds. As shown in FIG. 5, the ink cartridge 48 is disposed at a position slightly lower than the ejecting surface 17 of the recording head 4. Therefore, waiting a predetermined time as described above causes ink attached to the vicinities of the ejecting ports 16 in the ejecting surface 17 to be sucked into the recording head 4 due to the water head value.

Next, the control unit 58 activates the drive unit 37, brings the upper end face of the cap member 34 into contact with the ejecting surface 17, and ejects (discharges) ink from the ejecting ports 16 onto the cap member 34 (flushing) (step S10). In this way, thickened ink in the vicinities of the ejecting ports 16 is discharged, and the meniscuses of the ejecting ports 16 can be smoothed. At the end, the upper end face of the cap member 34 is kept in contact with the ejecting surface 17 (step S11). With this, the cleaning operation ends (step S12). If a recording operation on recording paper is to be started after the cleaning operation, the control unit 58 does not perform the operation of step S11.

In the above-described cleaning operation, wiping (step S5), which is performed after every capping (steps S2 to S4) in known cleaning operations, is not performed after the second capping (steps S6 to S8). Therefore, thickened ink can be prevented from being rubbed against the ejecting surface 17 by wiping (step S5). In addition, the ejecting surface 17 can be prevented from being wiped without sufficient ink thereon. Therefore, the ejecting surface 17 can be prevented from being damaged by wiping (step S5).

By waiting a predetermined time (step S9) after the second capping (steps S6 to S8), ink attached to the vicinities of the ejecting ports 16 in the ejecting surface 17 can be sucked into the recording head 4 from the ejecting port 16 due to the water head difference between the ejecting head 4 and the ink cartridge 48. Therefore, ink on the ejecting surface 17 can be removed without performing wiping again. Consequently, ink can be prevented from remaining on the ejecting surface 17 and thickening. By ending the cleaning operation with the upper end face of the cap member 34 in contact with the ejecting surface 17, ink can be prevented from evaporating, and therefore can be prevented from thickening.

Next, a second embodiment of a cleaning operation of the ink jet printer 1 will be described with reference to the flowchart of FIG. 9. Since steps S1 to S8 of this cleaning operation are the same as those of the cleaning operation described above with reference to FIG. 8, the same reference numerals will be used to designate the same steps so that the description thereof will be omitted.

After performing the processing of steps S1 to S8, the control unit 58 detects the temperature of the thermometer 46 using the measurement unit 61 to measure the temperature of the recording head 4. Next, the control unit 58 stores the measured temperature of the recording head 4 in the storage unit 60. Next, the control unit 58 compares the stored measured temperature to a set temperature that is preset and stored in the storage unit 60 (step S21). When ink having the properties shown in FIG. 7 is used, the set temperature is preferably, for example, about 30° C. The reason is that when the temperature of the recording head 4 is about 30° C. or more, the rate of evaporation exceeds about 40% and the ink is at increased risk of thickening.

Figure 8:
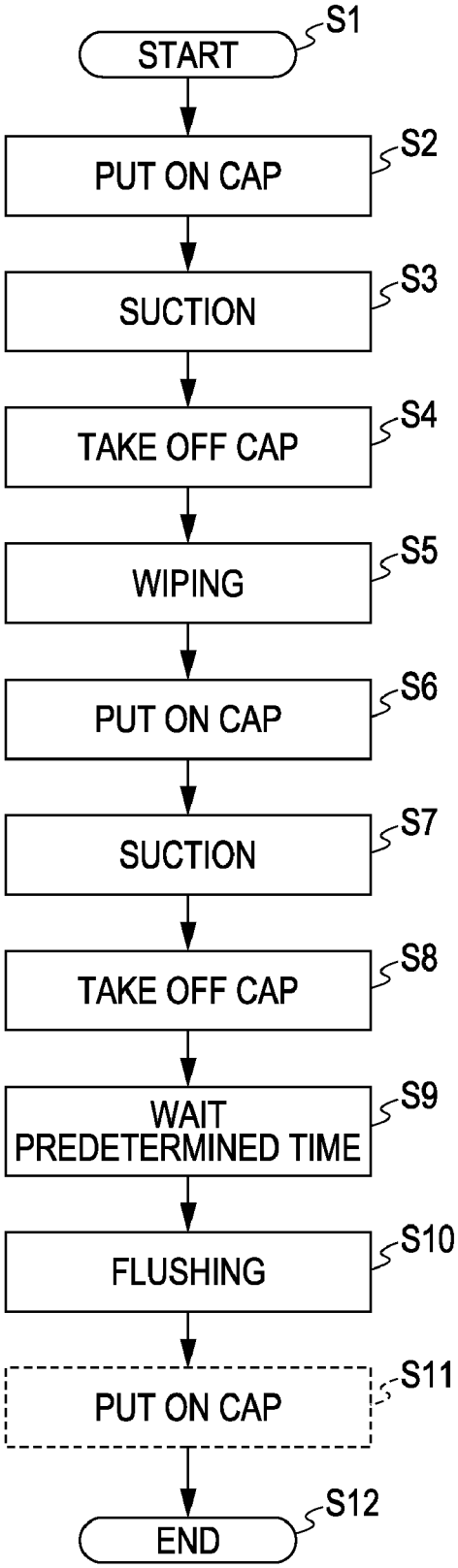
FIG. 8 is a flowchart for illustrating an example of an operation of an ink jet printer according to a first embodiment of the invention.

If the measured temperature is higher than or equal to the set temperature, as in steps S9 to S12 of FIG. 8, the control unit 58 waits a predetermined time without performing wiping (step S22) and performs flushing (step S24), and the cleaning operation ends (step S25). If the measured temperature is lower than the set temperature, as in step S5, the control unit 58 wipes the ejecting surface 17 of the recording head 4 (step S23). Next, as in step S10 shown in FIG. 8, the control unit 58 performs flushing (step S24), and the cleaning operation ends (step S25). If a recording operation on recording paper is not to be started after the cleaning operation, the upper end face of the cap member 34 may be kept in contact with the ejecting surface 17 after flushing, as in step S11 shown in FIG. 8.

According to the above-described cleaning operation, if the temperature of the recording head 4 becomes higher than or equal to the set temperature and thereby ink remaining on the ejecting surface 17 is thickened, the thickened ink can be prevented from being rubbed against the ejecting surface 17 by wiping and therefore the ejecting surface 17 can be prevented from being damaged. If the temperature of the recording head 4 is lower than the set temperature and ink remaining on the ejecting surface 17 is not thickened, the ink on the ejecting surface 17 can be removed by wiping. Therefore, the ejecting surface 17 can be prevented from being damaged by wiping.

Next, a third embodiment of a cleaning operation of the ink jet printer 1 will be described with reference to the flowchart of FIG. 10. This cleaning operation differs from the cleaning operation described above with reference to FIG. 9 in that step S31 is performed instead of step S21. Since the other steps are the same as those of the cleaning operation described above with reference to FIG. 9, the same reference numerals will be used to designate the same steps so that the description thereof will be omitted.

After performing the processing of steps S1 to S8, the control unit 58 calculates the elapsed time from the end of the last cleaning operation and the start of the present cleaning operation, using the measurement unit 61. Next, the control unit 58 stores the elapsed time in the storage unit 60 as a measured time. Next, the control unit 58 compares the stored measured time to a set time that is preset and stored in the storage unit 60 (step S31). The set time is preferably, for example, about 24 hours. The reason is that when the elapsed time from the end of the last cleaning operation to the start of the present cleaning operation exceeds 24 hours, the rate of evaporation of the ink exceeds about 40% and the ink is at increased risk of thickening.

Figure 9:
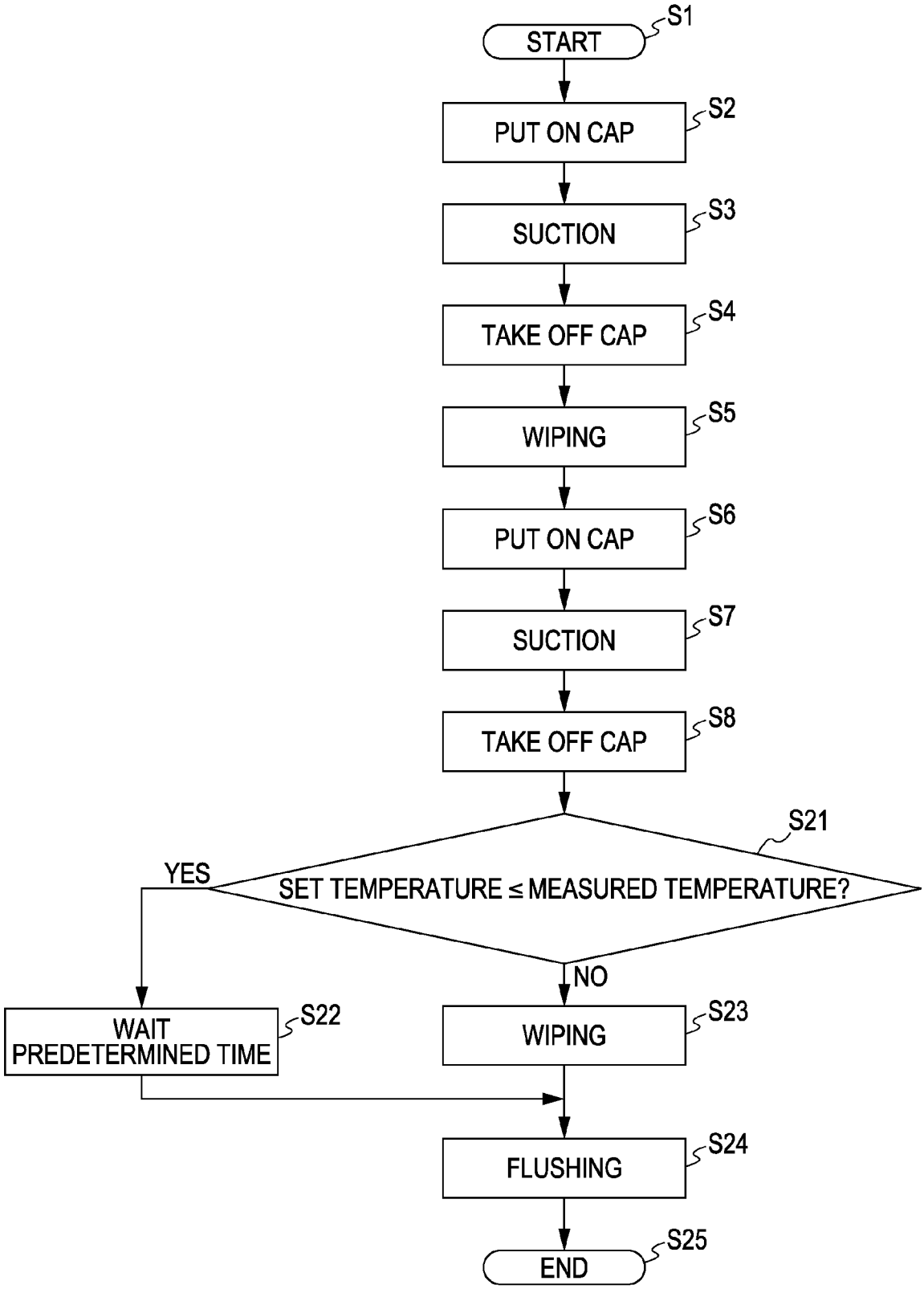
FIG. 9 is a flowchart for illustrating an example of an operation of an ink jet printer according to a second embodiment of the invention.

If the measured time exceeds the set time, as in steps S22, S24, and S25 shown in FIG. 9, the control unit 58 waits a predetermined time without performing wiping again (step S32) and performs flushing (step S34), and the cleaning operation ends (step S35). If the measured time is within the set time, as in steps S23 to S25 shown in FIG. 9, the control unit 58 wipes the ejecting surface 17 of the recording head 4 (step S33) and performs flushing (step S34) and the cleaning operation ends (step S35).

According to the above-described cleaning operation, if the predetermined time has elapsed since the last cleaning operation and thereby ink remaining on the ejecting surface 17 is thickened, the thickened ink can be prevented from being rubbed against the ejecting surface 17 by wiping and therefore the ejecting surface 17 can be prevented from being damaged. If the elapsed time since the last cleaning operation is within the predetermined time and ink remaining on the ejecting surface 17 is not thickened, the ink on the ejecting surface 17 can be removed by wiping. Therefore, the ejecting surface 17 can be prevented from being damaged by wiping.

Next, a fourth embodiment of a cleaning operation of the ink jet printer 1 will be described with reference to the flowchart of FIG. 11. This cleaning operation differs from the cleaning operation described above with reference to FIG. 9 in that step S41 is performed instead of step S21. Since the other steps are the same as those of the cleaning operation described above with reference to FIG. 9, the same reference numerals will be used to designate the same steps so that the description thereof will be omitted.

After performing the processing of steps S1 to S8, the control unit 58 determines the kind of started cleaning (step S41). The kinds of cleaning include, for example, a timer cleaning that is started after a lapse of a predetermined time, an ink cartridge replacement cleaning that is started when the detection unit 8 detects the replacement of the ink cartridge 48, an initial filling cleaning that is started at the time of the initial filling of ink, and a manual cleaning that is started manually.

In the determination of the kind of cleaning, the control unit 58 determines into which of types A and B shown in FIG. 12 the started cleaning falls. That is, if the started cleaning is a timer cleaning or an ink cartridge replacement cleaning, the cleaning is determined to fall into type A. If the kind of cleaning is an initial filling cleaning or a manual cleaning, the cleaning is determined to fall into type B.

In the case of a cleaning of type A, ink remaining on the ejecting surface 17 is relatively likely to be thickened at the start of the cleaning operation. In the case of a cleaning of type B, ink remaining on the ejecting surface 17 is relatively unlikely to be thickened at the start of the cleaning operation. Depending on the kind of ink or other design conditions, it is possible to categorize the manual cleaning into type A and the ink cartridge replacement cleaning into type B.

If the kind of cleaning is type A, as in steps S22, S24, and S25 shown in FIG. 9, the control unit 58 waits a predetermined time without performing wiping again (step S42) and performs flushing (step S44), and the cleaning operation ends (step S45). If the kind of cleaning is type B, as in steps S23 to S25 shown in FIG. 9, the control unit 58 wipes the ejecting surface 17 of the recording head 4 (step S43) and performs flushing (step S44), and the cleaning operation ends (step S45).

According to the above-described cleaning operation, if ink remaining on the ejecting surface 17 is thickened at the start of a cleaning operation of type A, the thickened ink can be prevented from being rubbed against the ejecting surface 17 by wiping and therefore the ejecting surface 17 can be prevented from being damaged. If ink remaining on the ejecting surface 17 is not thickened at the start of a cleaning operation of type B, the ink on the ejecting surface 17 can be removed by wiping.

Figure 10:
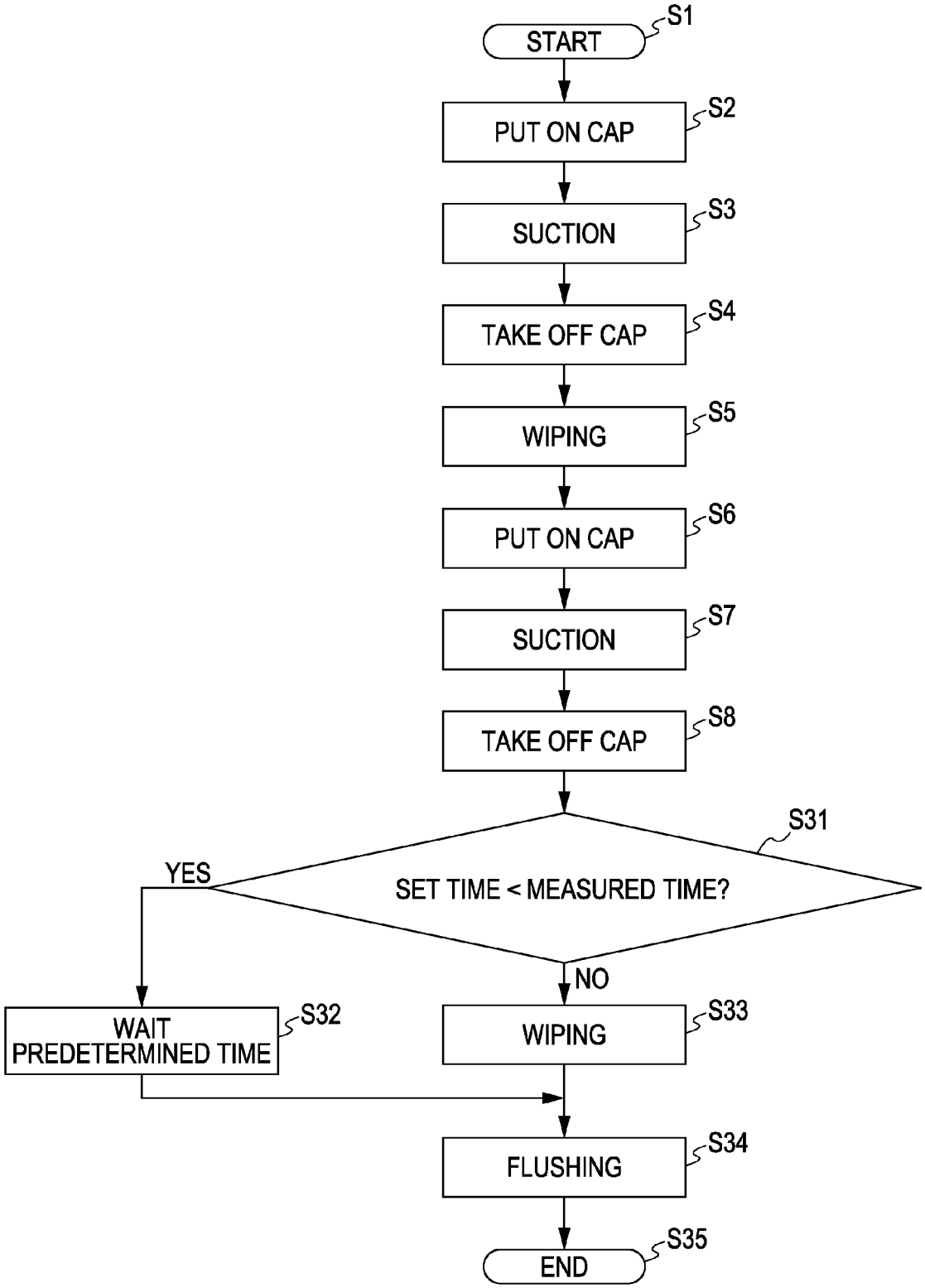
FIG. 10 is a flowchart for illustrating an example of an operation of an ink jet printer according to a third embodiment of the invention.
Figure 11:
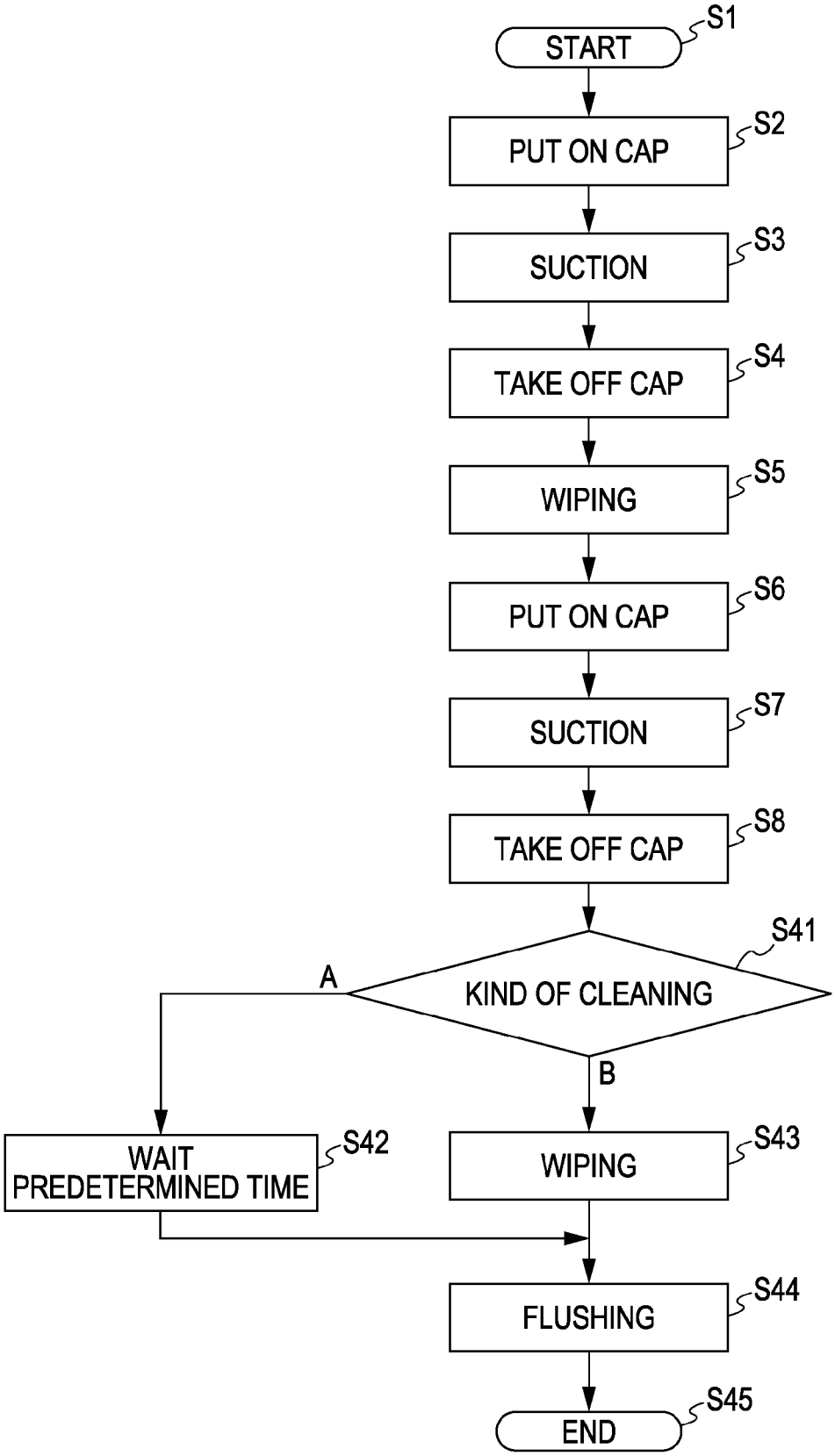
FIG. 11 is a flowchart for illustrating an example of an operation of an ink jet printer according to a fourth embodiment of the invention.

The control unit 58 ends the cleaning operation in step S25, S35, and S45 shown in FIGS. 9, 10, and 11, respectively, and then moves the recording head 4 to the recording region to start a recording operation on recording paper. As described above, in the ink jet printer 1 of this embodiment, in the case of use of a high-viscosity ink having a viscosity higher than that of known inks, by performing minimum necessary wiping, thickened ink can be prevented from being rubbed against the ejecting surface 17 by wiping. In the case of use of ejecting ports 16 having a diameter larger than that of known ejecting ports, the ejecting surface 17 can be prevented from being wiped without sufficient ink thereon. Therefore, in the ink jet printer 1 of this embodiment, the recording head 4 can be prevented from being damaged by cleaning.

In the above-described embodiments, a description is given taking the ink jet printer 1 as an example of an ink jet recording apparatus. However, examples of an ink jet recording apparatus are not limited to ink jet printers but include recording apparatuses such as copying machines and facsimiles.

In the above-described embodiments, a description is given taking a fluid ejecting apparatus (liquid ejecting apparatus) that ejects a fluid (liquid) such as ink as an example of a fluid ejecting apparatus. However, the fluid ejecting apparatus of the invention can be applied to fluid ejecting apparatuses that eject or discharge a fluid other than ink. Fluids that the fluid ejecting apparatus can eject include fluids, liquids in which particles of a functional material are dispersed or dissolved, gels, solids that can be ejected as fluids, and powders (for example, toners).

In the above-described embodiments, not only ink but also a fluid corresponding to a specific use can be used as a fluid (liquid) ejected from the fluid ejecting apparatus. By providing the fluid ejecting apparatus with an ejecting head that can eject the fluid corresponding to a specific use, ejecting the fluid corresponding to a specific use from the ejecting head, and attaching the fluid to a predetermined object, a predetermined device can be manufactured. For example, the fluid ejecting apparatus (liquid ejecting apparatus) of the invention is applicable to fluid ejecting apparatuses that eject a fluid (liquid) in which a material such as an electrode material or a color material used for manufacturing liquid crystal displays, EL (electroluminescence) displays, and FEDs (field emission displays) is dispersed (dissolved) in a predetermined dispersion medium (solvent).

Fluid ejecting apparatuses include fluid ejecting apparatuses that eject bioorganic matter used for manufacturing biochips and fluid ejecting apparatuses that are used as a precise pipette and eject a sample fluid. Fluid ejecting apparatuses further include fluid ejecting apparatuses that eject lubricating oil onto precision machines such as watches and cameras in a pinpoint manner, fluid ejecting apparatuses that eject transparent resin liquid such as ultraviolet curable resin onto a substrate to form a micro hemispherical lens (optical lens) used in an optical communication element, fluid ejecting apparatuses that eject etching liquid such as acid or alkali to etch a substrate, fluid ejecting apparatuses that eject gel, and toner jet recording apparatuses that eject solids, for example, powders such as toners. The invention can be applied to any one of these fluid ejecting apparatuses.

The structure of the tube pump is not limited to that shown in FIG. 4. Instead of pulling out the ends of the circularly curved tube member in the opposite direction to each other and crossing them, it is possible to pull out the ends of the circularly curved tube member in the same direction and bundle them in the same plane. A tube pump such as that disclosed in, for example, JP-A-2006-257928 can also be used as the suction unit 35.

What is claimed is:

1. A method for maintaining a fluid ejecting apparatus including an ejecting head that has an ejecting surface in which a plurality of ejecting ports that eject fluid are formed, and a maintenance portion that performs maintenance processing to recover the ejection of fluid from the ejecting ports and that has a cap member and a wiping member, the method comprising:

performing a first capping process to put the cap member on the ejecting surface of the ejection head;

performing a first suction process to suck the fluid in a space formed between the cap member and the ejecting surface;

performing a wiping process to wipe the ejecting surface with the wiping member;

performing a second suction process to suck fluid in the space between the cap member and the ejecting surface; and performing a waiting process to wait the a predetermined time without performing a second wiping process.

2. The method according to claim 1, wherein after the second suction process is performed, the temperature of the ejecting head is measured, the measured temperature is compared to a preset set temperature, and if the temperature of the ejecting head is higher than or equal to the set temperature, the waiting process is performed for the predetermined time without performing the second wiping processing.

3. The method according to claim 1, wherein after the second suction process is performed, the elapsed time since the last maintenance processing is measured, the measured time is compared to a preset set time, and if the measured time exceeds the set time, the waiting process is performed for the predetermined time without performing the second wiping processing.

4. The method according to claim 1, wherein after the second suction process is performed, the kind of performed cleaning is determined, and if the kind of cleaning is a timer cleaning after an elapse of a set time, the waiting process is performed for the predetermined time without performing the second wiping processing.

5. The method according to claim 1, further comprising performing flushing processing to put the cap member on the ejecting surface and to eject liquid from the ejecting ports.

6. The method according to claim 5, further comprising keeping the cap member put on the ejecting surface.

7. A fluid ejecting apparatus comprising:

an ejecting head that has an ejecting surface in which a plurality of ejecting ports that eject fluid are formed;

a maintenance portion that performs maintenance processing to recover the ejection of fluid from the ejecting ports and that has a cap member and a wiping member; and a control portion that controls the maintenance portion, wherein the control portion causes the maintenance portion to perform the following:

a first capping process to put the cap member on the ejecting surface;

a first suction process to suck the fluid in a space formed between the cap member and the ejecting surface, wherein the first capping process and the first suction process are performed prior to any wiping process being performed;

a wiping process to wipe the ejecting surface with the wiping member;

a second suction process to suck the fluid in the space formed between the cap member and the ejecting surface; and a waiting process to wait a predetermined time without performing a second wiping process.

* * * * *